United States Patent [19]

Hanlon et al.

[11] Patent Number: 4,553,979

[45] Date of Patent: Nov. 19, 1985

[54] DIESEL FUEL COMPOSITIONS

[75] Inventors: J. Vincent Hanlon, Baton Rouge, La.; Denis L. Lenane, St. Louis, Mo.; James B. Retzloff, Pinckney, Mich.

[73] Assignee: Ethyl Petroleum Additives, Inc., St. Louis, Mo.

[21] Appl. No.: 661,222

[22] Filed: Oct. 15, 1984

[51] Int. Cl.[4] ..... C10L 1/22

[52] U.S. Cl. ..... 44/57; 44/73; 44/75

[58] Field of Search ..... 44/57, 63, 75

[56] References Cited

U.S. PATENT DOCUMENTS

| | | | |
|---|---|---|---|
| 2,280,217 | 4/1942 | Cloud | 44/57 |
| 2,785,662 | 3/1957 | Boyce | 44/57 |
| 3,980,569 | 9/1976 | Pindar et al. | 44/75 |
| 3,994,698 | 11/1976 | Worrel | 44/73 |
| 4,116,644 | 9/1978 | Jackisch et al. | 44/75 |
| 4,482,356 | 11/1984 | Hanlon | 44/57 |

*Primary Examiner*—Y. Harris-Smith

*Attorney, Agent, or Firm*—Donald L. Johnson; John F. Sieberth; W. G. Montgomery

[57] ABSTRACT

Coking in and around the injector nozzles of indirect injection compression ignition engines is reduced by means of distillate fuel with which has been blended suitable concentration of:

(a) organic nitrate ignition accelerator, and (b) the condensation product of a phenol, preferably a high molecular weight alkylphenol, and aldehyde and an amine having a H-N< group.

Also described are additive mixtures of (a) and (b) for use in distillate fuels in amounts sufficient to reduce the coking tendencies of such fuels when used in the operation of indirect injection compression ignition engines.

16 Claims, 1 Drawing Figure

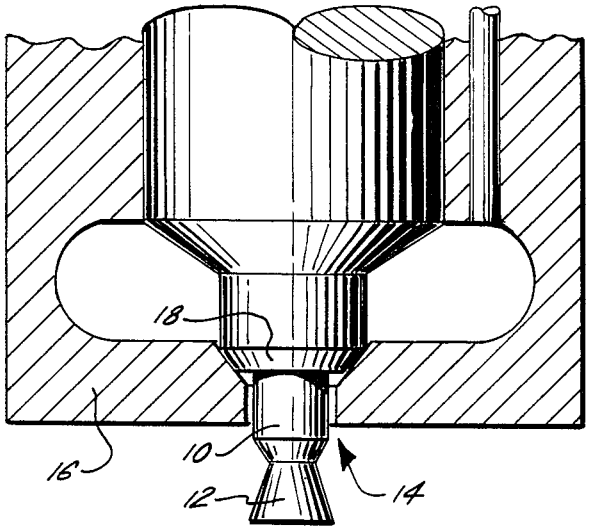
18
16
10
12
14

DIESEL FUEL COMPOSITIONS

FIELD

Compression ignition fuel compositions and additive mixtures of organic nitrate ignition accelerator and the condensation product of a high molecular weight alkylphenol, an aldehyde and an amine having a H-N< group in amounts sufficient to resist the coking tendencies of compression ignition fuel compositions when used in the operation of indirect injection diesel engines.

BACKGROUND

Throttling diesel nozzles have recently come into wide-spread use in indirect injection automotive and light-duty diesel truck engines, i.e., compression ignition engines in which the fuel is injected into and ignited in a prechamber or swirl chamber. In this way, the flame front proceeds from the prechamber into the larger compression chamber where the combustion is completed. Engines designed in this manner allow for quieter and smoother operation. The FIGURE of the Drawing illustrates the geometry of the typical throttling diesel nozzle (often referred to as the "pintle nozzle").

Unfortunately, the advent of such engines has given rise to a new problem, that of excessive coking on the critical surfaces of the injectors that inject fuel into the prechamber or swirl chamber of the engine. In particular and with reference to the FIGURE, the carbon tends to fill in all of the available corners and surfaces of the obturator 10 and the form 12 until a smooth profile is achieved. The carbon also tends to block the drilled orifice 14 in the injector body 16 and fill up to the seat 18. In severe cases, carbon builds up on the form 12 and the obturator 10 to such an extent that it interfers with the spray pattern of the fuel issuing from around the perimeter of orifice 14. Such carbon build up or coking often results in such undesirable consequences as delayed fuel injection, increased rate of fuel injection, increased rate of combustion chamber pressure rise, and increased engine noise, and can also result in an excessive increase in emission from the engine of unburned hydrocarbons.

While low fuel cetane number is believed to be a major contributing factor to the coking problem, it is not the only relevant factor. Thermal and oxidative stability (lacquering tendencies), fuel aromaticity, and such fuel characteristics as viscosity, surface tension and relative density have also been indicated to play a role in the coking problem.

An important contribution to the art would be a fuel composition which has enhanced resistance to coking tendencies when employed in the operation of indirect injection diesel engines.

THE INVENTION

In accordance with one of its embodiments, this invention provides distillate fuel for indirect injection compression ignition engines containing at least the combination of (a) organic nitrate ignition accelerator, and (b) the condensation product of a high molecular weight alkylphenol, an aldehyde and an amine having at least one active hydrogen atom bonded to an amino nitrogen atom, said combination being present in an amount sufficient to minimize coking, especially throttling nozzle coking, in the prechambers or swirl chambers of indirect injection compression ignition engines operated on such fuel.

Another embodiment of the present invention is a distillate fuel additive fluid composition comprising (a) organic nitrate ignition accelerator, and (b) the condensation product of a high molecular weight alkylphenol, an aldehyde and an amine having at least one active hydrogen atom bonded to an amino nitrogen atom, in an amount sufficient to minimize the coking characteristics of such fuel, especially throttling nozzle coking, in the prechambers or swirl chambers of indirect compression ignition engines operated on such fuel.

Since the invention also embodies the operation of an indirect injection compression ignition engine in a manner which results in reduced coking, a still further embodiment of the present invention is a method of inhibiting coking, especially throttling nozzle coking, in the prechambers or swirl chambers of an indirect injection compression ignition engine, which comprises supplying said engine with a distillate fuel containing at least the combination of (a) organic nitrate ignition accelerator, and (b) the condensation product of a high molecular weight alkylphenol, an aldehyde and an amine having at least one active hydrogen atom bonded to an amino nitrogen atom, said combination being present in an amount sufficient to minimize such coking in an engine operated on such fuel.

A feature of this invention is that the combination of additives utilized in its practice is capable of suppressing coking tendencies of fuels used to operate indirect injection compression ignition engines. Such behavior was exhibited in a series of standard engine dynamometer tests conducted as described in Example I hereinafter.

A wide variety of organic nitrate ignition accelerators may be employed in the fuels of this invention. Preferred nitrate esters are the aliphatic or cycloaliphatic nitrates in which the aliphatic or cycloaliphatic group is saturated, contains up to about 12 carbons and, optionally, may be substituted with one or more oxygen atoms.

Typical organic nitrates that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, and the like. Mixtures of such materials may also be used. The preferred ignition accelerator for use in the fuels of this invention is a mixture of octyl nitrates available as an article of commerce from Ethyl Corporation under the designation DII-3 ignition improver.

The nitrate ignition accelerator—component (a)—should be present in an amount of at least 100 to 1000 PTB (pounds per thousand barrels) of the base fuel. Preferably, the concentration of the ignition accelerator is about 400 to 600 PTB.

The condensation products, component (b) of the fuels of this invention, are well known. They are made by condensing a phenol and preferably a high molecular weight alkylphenol, an aldehyde and ammonia or preferably an aliphatic amine having at least one reactive hydrogen atom bonded to nitrogen. In other words, an amine having at least one H-N< group. This reaction is the well-known "Mannich reaction" (see "Organic Reactions," Volume I). The conditions for carrying out such a condensation are well known.

The preferred alkylphenol reactant is an alkylphenol wherein the alkyl radical has an average molecular weight of from about 400 to 1500. In a more preferred alkylphenol reactant the alkyl radical has an average molecular weight of from about 800 to 1300, and in the most preferred alkylphenols the alkyl radical has an average molecular weight of from about 900 to 1100.

Alkylphenols suitable for use in the preparation of the present invention are readily prepared by adaptation of methods well known in the art. For example, they may be prepared by the acid catalyzed alkylation of phenol with an olefin. In this method, a small amount of an acid catalyst such as sulfuric or phosphoric acid, or preferably a Lewis acid such as $BF_3$-etherate, $BF_3$-phenate complex or $AlCl_2$-$HSO_4$, is added to the phenol and the olefin then added to the phenol at temperatures ranging from about 0° C. up to 200° C. A preferred temperature range for this alkylation is from about 25° C. to 150° C., and the most preferred range is from about 50° C. to 100° C. The alkylation is readily carried out at atmospheric pressures, but if higher temperatures are employed the alkylation may be carried out at super atmospheric pressures up to about 1000 psig.

The alkylation of phenols produces a mixture of mono-, di-and tri-alkyklation phenols. Although the preferred reactants are the mono-alkylated phenols, the alkylation mixture can be used without removing the higher alkylation products. The alkylation mixture formed by alkylating phenol with an olefin using an acid catalyst can be merely water washed to remove the unalkylated phenol and the acid catalyst and then used in the condensation reaction without removing the di- and tri-alkylated phenol products. Another method of removing the unreacted phenol is to distill it out, preferably using steam distillation or under vacuum, after washing out the alkylation catalyst. The amount of di-and tri-alkylated phenols can be kept at a minimum by restricting the amount of olefin reactant added to the phenol. Good results are obtained when the mole ratio of olefin to phenol is about 0.25 moles of olefin per mole of phenol to 1.0 mole of olefin per mole of phenol. A more preferred ratio is from about 0.33 to 0.9, and a most preferred ratio is from about 0.5 to 0.67 moles of olefin per mole of phenol.

The olefin reactant used to alkylate the phenol is preferably a monoolefin with an average molecular weight of from about 400 to 1500. The more preferred olefins are those formed from the polymerization of low molecular weight olefins containing from about 2 to 10 carbon atoms, such as ethylene, propylene, butylene, pentene and decene. These result in polyalkene substituted phenols. A most preferred olefin is that made by the polymerization of propylene or butene to produce a polypropylene or polybutene mixture with an average molecular weight of from about 900–1100. This gives the highly preferred polypropylene and polybutene substituted phenols.

The aldehyde reactant preferably contains from 1 to 7 carbon atoms. Examples are formaldehyde, acetaldehyde, propionaldehyde, butyraldehyde, valeraldehyde, hexaldehyde and heptaldehyde. The more preferred aldehyde reactants are the low molecular weight aliphatic aldehydes containing from 1 to about 4 carbon atoms such as formaldehyde, acetaldehyde, butyraldehyde and isobutyraldehyde. The most preferred aldehyde reactant is formaldehyde, which may be used in its monomeric or its polymeric form such as paraformaldehyde.

The amine reactants include those that contain at least one active hydrogen atom bonded to an amino nitrogen atom, such that they can partake in a Mannich condensation. They may be primary amines, secondary amines or may contain both primary and secondary amino groups. Examples include the primary alkyl amines such as methyl amine, ethyl amine, n-propyl amine, isopropyl amine, n-butyl amine, isobutyl amine, 2-ethylhexyl amine, dodecyl amine, stearyl amine, eicosyl amine, triacontyl amine, pentacontyl amine, and the like, including those in which the alkyl group contains from 1 to about 50 carbon atoms. Also, dialkyl amines may be used such as dimethyl amine, diethyl amine, methylethyl amine, methylbutyl amine, di-n-hexyl amine, methyl dodecyl amine, dieicosyl amine, methyl triacontyl amine, dipentacontyl amine, and the like, including mixtures thereof.

Another useful class is the N-substituted compounds such as the N-alkyl imidazolidines and pyrimidines. Also, aromatic amines having a reactive hydrogen atom attached to nitrogen can be used. These include aniline, N-methyl aniline, ortho, meta and para phenylene diamines, α-naphthyl amine, N-isopropyl phenylene diamine, and the like. Secondary heterocyclic amines are likewise useful including morpholine, thiomorpholine, pyrrole, pyrroline, pyrrolidine, indole, pyrazole, pyrazoline, pyrazolidine, imidazole, imidazoline, imidazolidine, piperidine, phenoxazine, phenathiazine, and mixtures thereof, including their substituted homologs in which the substituent groups include alkyl, aryl, alkaryl, aralkyl, cycloalkyl, and the like.

A preferred class of amine reactants is the diamines represented by the formula:

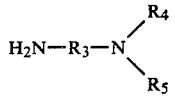

wherein $R_3$ is a divalent alkylene radical containing 1–6 carbon atoms, and $R_4$ and $R_5$ are selected from the group consisting of alkyl radicals containing from 1–6 carbon atoms and radicals having the formula:

$$-R_6-X$$

wherein $R_6$ is a divalent alkylene radical containing from 1–6 carbon atoms, and X is selected from the group consisting of the hydroxyl radical and the amine radical.

The term "divalent alkylene radical" as used herein means a divalent saturated aliphatic hydrocarbon radical having the empirical formula:

$$-C_nH_{2n}-$$

wherein n is an integer from 1 to about 6. Preferably, $R_3$ is a lower alkylene radical such as the $-C_2H_4-$, $-C_3H_6-$, or $C_4H_6-$ groups. The two amine groups may be bonded to the same or different carbon atoms. Some examples of diamine reactants wherein the amine groups are attached to the same carbon atoms of the alkylene radical $R_3$ are N,N-dialkylmethylenediamine, N,N-dialkanol-1,3-ethanediamine, and N,N-di(aminoalkyl)-2,2-propanediamine.

Some examples of diamine reactants in which the amine groups are bonded to adjacent carbon atoms of the $R_3$ alkylene radical are N,N-dialkyl-1,2-ethanediamine, N,N-dialkanol-1,2-propanediamine, N,N-di(aminoalkyl)-2,3-butanediamine, and N,N-dialkyl-2,3-(4-methylpentane)diamine.

Some examples of diamine reactants in which the amine groups are bonded to carbon atoms on the alkylene radical represented by $R_3$ which are removed from each other by one or more interventing carbon atoms are N,N-dialkyl-1,3-propanediamine, N,N-dialkanol-1,3-butanediamine, N,N-di(aminoalkyl)-1,4-butanediamine, and N,N-dialkyl-1,3 hexanediamine.

As previously stated, $R_4$ and $R_5$ are alkyl radicals containing 1 to 6 carbon atoms which are substituted with the hydroxyl or amine radical. Some examples of hydroxyl substituted radicals are 2-hydroxy-n-propyl, 2-hydroxyethyl, 2-hydroxy-n-hexyl, 3-hydroxy-n-propyl, 4-hydroxy-3-ethyl-n-butyl, and the like. Some examples of amine substituted $R_4$ and $R_5$ radicals are 2-amino-ethyl, 2-amino-n-propyl, 4-amino-n-butyl, 4-amino-3,3-dimethyl-n-butyl, 6-amino-n-hexyl, and the like. Preferred $R_4$ and $R_5$ radicals are unsubstituted alkyl radicals such as methyl, ethyl, n-propyl, isopropyl, sec-butyl, n-amyl, n-hexyl, 2-methyl-n-pentyl, and the like. The most preferred $R_4$ and $R_5$ substituents are methyl radicals.

Some specific examples of diamine reactants are N,N-dimethyl-1,3-propanediamine, N,N-dibutyl-1,3-propanediamine, N,N-dihexyl-1,3-propanediamine, N,N-dimethyl-1,2-propanediamine, N.N-dimethyl-1,1-propanediamine, N,N-dimethyl-1,3-hexanediamine, N,N-dimethyl-1,3-butanediamine, N,N-di(2-hydroxyethyl)-1,3-propanediamine, N,N-di(2-hydroxybutyl)-1,3-propanediamine, N,N-di(6-hydroxyhexyl)-1,1-hexanediamine, N,N-di(2-aminoethyl)-1,3-propanediamine, N,N-di(2-amino-n-hexyl)-1,2-butanediamine, N,N-di(4-amino-3,3-di-methyl-n-butyl)-4-methyl-1,3-pentanediamine, and N-(2-hydroxyethyl)-N-(2-aminoethyl)-1,3-propanediamine.

Another very useful class of amine reactants is the alkylene polyamines which have the formula:

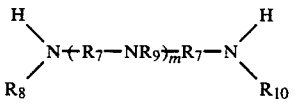

wherein $R_8$, $R_9$ and $R_{10}$ are selected from hydrogen and lower alkyl radicals containing 1–4 carbon atoms, and $R_7$ is a divalent saturated aliphatic hydrocarbon radical containing from 2 to about 4 carbon atoms and m is an integer from 0 to about 4. Examples of these are ethylene diamine, diethylene triamine, propylene diamine, dipropylene triamine, tripropylene tetramine, tetrapropylene pentamine, butylene diamine, dibutylene trimine, diisobutylene triamine, tributylene tetramine, and the like, including the $NC_{1-4}$alkylsubstituted homologs.

A most preferred class of amine reactants is the ethylene polyamines. These are described in detail in Kirk-Othmer, "Encyclopedia of Chemical Technology," Vol. 5, pages 898–9, Interscience Pulbishers, Inc., New York. These include the series ethylene diamine, diethylene triamine, triethylene tetramine, tetraethylene pentamine, pentaethylene hexamine, and the like. A particularly preferred amine reactant is a mixture of ethylene polyamines containing a substantial amount of triethylene tetramine and tetraethylene pentamine.

The condensation products are easily prepared by mixing together the alkylphenol, the aldehyde reactant and the amine reactant, and heating them to a temperature sufficient to cause the reaction to occur. The reaction may be carried out without any solvent, but the use of a solvent is usually preferred. Preferred solvents are the water immiscible solvents including water-insoluable alcohols (e.g., amyl alcohol) and hydrocarbons. The more preferred water-immiscible solvents are hydrocarbon solvents boiling from 50° C. to about 100° C. Highly preferred solvents are the aromatic hydrocarbon solvents such as benzene, toluene, xylene, and the like. Of these, the most preferred solvent is toluene. The amount of solvent employed is not critical. Good results are obtained when from one to about 50 percent of the reaction mass is solvent. A more preferred quantity is from 3 to about 25 percent, and a most preferred quantity of solvent is from about 5 to 10 percent.

The ratio of reactants per mole of alkylphenol can vary from about 1 to 5 moles of aldehyde reactant and 0.5–5 moles of amine reactant. Molar amounts of amine less than one can be used when the amine contains more than one H-N< group, such as in the ethylene polyamines (e.g., tetraethylenepentamine). A more preferred reactant ratio based on one mole of alkylphenol is from 2.5 to 4 moles of aldehyde and from 1.5 to 2.5 moles of amine reactant. A most preferred ratio of reactants is about 2 moles of alkylphenol to about 3 moles of aldehyde to about 2 moles of amine reactant. This ratio gives an especially useful product when the alkylphenol is a polybutene-substituted phenol in which the polybutene group has a molecular weight of about 900–1100, the aldehyde is formaldehyde and the amine is N,N-dimethyl-1,3-propanediamine.

The condensation reaction will occur by simply warming the reactant mixture to a temperature sufficient to effect the reaction. The reaction will proceed at temperatures ranging from about 50° C. to 200° C. A more preferred temperature range is from about 75° C. to 175° C. When a solvent is employed it is desirable to conduct the reaction at the reflux temperature of the solvent-containing reaction mass. For example, when toluene is used as the solvent, the condensation proceeds at about 100° C. to 150° C. as the water formed in the reaction is removed. The water formed in the reaction co-distills together with the water-immiscible solvent, permitting its removal from the reaction zone. During this water removal portion of the reaction period the water-immiscible solvent is returned to the reaction zone after separating water from it.

The time required to complete the reaction depends upon the reactants employed and the reaction temperature used. Under most conditions the reaction is complete in from about 1 to 8 hours.

The reaction product is a viscous oil and is usually diluted with a neutral oil to aid in handling. A particularly useful mixture is about two-thirds condensation product and one-third neutral oil.

U.S. Pat. No. 4,116,644, incorporated herein by reference, gives a description of the condensation products suitable for use in the fuels of this invention and methods for their preparation.

Thus, is a highly preferred embodiment of the invention there is provided distillate fuel for indirect injection compression ignition engines containing at least the combination of (a) organic nitrate ignition accelerator, and (b) the condensation product of:

(A) one mole part of an alkylphenol having the formula:

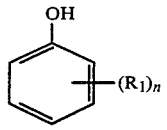

wherein n is an integer from 1 to 2 are $R_1$ is an aliphatic hydrocarbon radical having an average moleculer weight of from about 400 to 1500;

(B) from 1–5 mole parts of an aldehyde having the formula:

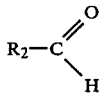

wherein $R_2$ is selected from hydrogen and alkyl radicals containing 1 to 6 carbon atoms; and (C) from 0.5–5 mole parts of an amine having at least one active hydrogen atom bonded to an amino nitrogen atom said combination being present in an amount sufficient to minimize coking on the nozzles of indirect injection compression ignition engines operated on such fuel.

In another highly preferred embodiment of the invention there is provided a distillate fuel additive fluid composition comprising (a) organic nitrate ignition accelerator, and (b) the condensation product of:

(A) one mole part of an alkylphenol having the formula:

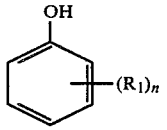

wherein n is an integer from 1 to 2 and $R_1$ is an aliphatic hydrocarbon radical having an average molecular weight of from about 400 to 1500;

(B) from 1–5 mole parts of an aldehyde having the formula:

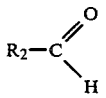

wherein $R_2$ is selected from hydrogen and alkyl radicals containing 1 to 6 carbon atoms; and (C) from 0.5–5 mole parts of an amine having at least one active hydrogen atom bonded to an amino nitrogen atom.

The fuels of this invention should contain at least 40 PTB (pounds per thousand barrels) of component (b), the condensation product, although smaller amounts may be successfully employed.

It is not believed that there is anything critical as regards the maximum amount of components (a) and (b) used in the fuel. Thus, the maximum amount of these components will probably be governed in any given situation by matters of choice and economics.

The coking-inhibiting components (a) and (b) of the invention can be added to the fuels by any means known in the art for incorporating small quantities of additives into distillate fuels. Components (a) and (b) can be added separately or they can be combined and added together. It is convenient to utilize additive fluid mixtures which consist of organic nitrate ignition accelerator and the condensation products of this invention. These additive fluid mixtures are added to distillate fuels. In other words, part of the present invention are coking inhibiting fluids which comprise organic nitrate ignition accelerator and the condensation product of a high molecular weight alkylphenol, an aldehyde and an amine having a H-N< group.

Use of such fluids in addition to resulting in great convenience in storage, handling, transportation, blending with fuels, and so forth, also are potent concentrates which serve the function of inhibiting or minimizing the coking characteristics of compression ignition distillate fuels used to operate indirect compression ignition engines.

In these fluid compositions, the amount of components (a) and (b) can vary widely. In general, the fluid compositions contain about 5% to 95% by weight of the organic nitrate ignition accelerator component and from about 95% to 5% by weight of the condensation product component. Typically, from about 0.01% by weight up to about 1.0% by weight of the combination will be sufficient to provide good coking-inhibiting properties to the distillate fuel. A preferred distillate fuel composition contains from about 0.1% to about 0.5% by weight of the combination containing from about 25% to about 95% by weight of the organic nitrate ignition accelerator, and from about 75% to about 5% by weight of the condensation product component.

The additive fluids, as well as the distillate fuel compositions of the present invention may also contain other additives such as, corrosion inhibitors, antioxidants, metal deactivators, detergents, cold flow improvers, inert solvents or diluents, and the like.

The practice and advantages of this invention will become still further apparent from the following illustrative examples.

EXAMPLE 1

In order to determine the effect of the fuel compositions of the present invention on the coking tendency of diesel injectors in indirect injection compression ignition engines, use was made of a commercial diesel engine operated on a coking test cycle similar to a coking test cycle developed by Institute Francais Petrole and described below. The amount of coking together with a quantitative indication of the adverse consequences of such coking was determined by means of (i) emission of unburned hydrocarbons, (ii) engine noise, and (iii) injector deposit ratings. The engine employed in the tests was a 1982 Peugeot 2.3 liter, 4-cylinder, turbocharged XD2S diesel engine connected to a Midwest dynamometer through an engine clutch. This engine is equipped with Bosch injectors positioned within prechambers, and is deemed representative of the indirect injection compression ignition engines widely used in automobiles and light-duty trucks.

The base fuel employed in these engine tests was a commercially-available diesel fuel having a nominal cetane rating of 46.2. FIA analysis indicated the fuel was composed by volume of 32.1% aromatics. Its distillation range (ASTM D-86) was as follows:

| Distillation Range | °F. |
|---|---|
| IBP | 375 |
| 10% Point | 431 |
| 50% Point | 505 |
| 90% Point | 598 |
| End Point | 653 |

Other inspection data on the base fuel were as follows:

| | |
|---|---|
| Kinematic Viscosity, (ASTM D-445) | 2.52 Centistokes, 40° C. |
| Flash Point (ASTM D-93) | 162° F. |
| Particulate Matter | 2.1 mg/l |
| Total Sulfur | 0.35 wt. % |
| Gravity (ASTM D-287) | 35.2 °API |
| Cetane rating | 46.2 |

A test blend was prepared from this base fuel (Fuel A). Fuel A contained a combination of (i) 509 PTB of mixed octyl nitrates (a commercial product available from Ethyl Corporation under the designation DII-3 Ignition Improver), (ii) 38 PTB of the reaction product of a polybutene-substituted phenol in which the polybutene group had a molecular weight of about 900–1100, formaldehyde and N,N-dimethyl-1,3-propanediamine, and (iii) 1.2 PTB of "Ethyl" Metal Deactivator, a product of Ethyl Corporation, the active ingredient of which is N,N'-disalicylidene-1,2-diaminopropane.

The manufacturer gives the following typical properties for its "Ethyl" Metal Deactivator:

| | |
|---|---|
| Form | Liquid |
| Color | Amber |
| Density, at 68° F. | |
| g/ml | 1.0672 |
| lb/gal | 8.91 |
| Active ingredient, wt % | 80 |
| Solvent vehicle (toluene), wt % | 20 |
| Flash point, open cup, °F. | 84 |
| Fire point, °F. | 100 |
| Solubility | |
| In gasoline (Typical) | Saturated solution contains 94% MDA |
| In water, wt. % | 0.04 |

Fuel A also contained 1.0 PTB of a corrosion inhibitor produced by the Alox Corporation of Niagara Falls, N.Y. sold commercially under the designation Alox 1846. The product is described by the manufacturer as an oxygenerated hyrocarbon in which a portion of the free organic acid produced by oxidation is neutralized with an amine. The manufacturer lists the following typical properties for its "Alox 1846" corrosion inhibitor:

| | |
|---|---|
| PERCENT WATER | Nil |
| PERCENT ASH | Nil |
| SPECIFIC GRAVITY @ 60° F. (API) | 27.9 |
| WEIGHT PER GALLON | 7.39 lbs. |
| POUR POINT | +20° F. |
| FLASH POINT (C.O.C.) | 175° F. |
| SOLUBILITY | Completely soluble in petroleum hydrocarbons insoluble in water. |

Also present in the fuel was 19 PTB of a solvent comprised of a mixture of $C_8$ to $C_{13}$ aromatic hydrocarbons produced by the Ashland Chemical Company of Columbus, Ohio and sold under the designation Hysol 70B and 1.2 PTB of a demulsifier produced by the Treatolite Division of the Petrolite Corporation of St. Louis sold under the designation Tolad 286 which is believed to consist for the most part of an aryl sulfonate, a polyether glycol and an oxyalkylated phenol formaldehyde resin.

Shell Rotella T, an SAE 30, SF/CD oil was used as the crankcase lubricant.

Before starting each test, new Bosch DNOSD—1510 nozzles were installed using new copper gaskets and flame rings. The fuel line was flushed with the new test fuel composition to be tested and the fuel filter bowl and fuel return reservoir were emptied to avoid additive carry-over from test-to-test.

At the start of each test, the engine was operated at 1000 rpm, light load for 15 minutes. After this warm-up, the engine was subjected to the following automatic cycle:

| Event | RPM | Beam Load | Minutes | EGR |
|---|---|---|---|---|
| 1 | 750 | 0 | 24 | off |
| 2 | 2750 | 12.0 | 6 | on |
| 3 | 1500 | 6.2 | 6 | on |

The above 16-minute cycle was repeated 75 times and the test was completed by running the engine at idle for another 30 minutes. The total elapsed time was thus 20.5 hours per test.

When passing from one event to the next event in the above cycle, some time, of course, was required to enable the engine to accelerate or decelerate from one speed to the next. Thus, more specifically, the above cycle was programmed as follows:

| Segment | Seconds | rpm | Beam Load |
|---|---|---|---|
| 1 | 2 | 750 | 0 |
| 2 | 200 | 750 | 0 |
| 3 | 3* | 2500 | 12 |
| 4 | 7* | 2750 | 12 |
| 5 | 350 | 2750 | 12 |
| 6 | 3* | 2275 | 6.2 |
| 7 | 7* | 1500 | 6.2 |
| 8 | 350 | 1500 | 6.2 |
| 9 | 7* | 750 | 0 |
| 10 | 30 | 750 | 0 |

*Represents two mode periods for acceleration or deceleration to the next condition.

Hydrocarbon exhaust emissions were measured at the start of each test (after the first 16-minute cycle), at the 6-hour test interval and at the end of the test. These measurements were made at 750, 1000, and 1400 rpm idle. Noise level readings were made at a location three feet from the engine exhaust side. The measurements were made at the start and at the end of the test while operating at three idle speeds, viz., 750, 1000 and 1400 rpm.

After the test operation, the injectors were carefully removed from the engine so as not to disturb the deposits formed thereon and pintle deposits were rated using the CRC deposit rating system.

The most significant test results are given in Table I, in which hydrocarbon emissions are expressed as ppm.

TABLE 1

| | Injector Deposits, 10 = Clean | | | | | | | | | | | | | |
|---|---|---|---|---|---|---|---|---|---|---|---|---|---|---|
| | Pintle | | | | Nozzle | Noise Db (A) | | | HC, ppm | | | CO, ppm | | |
| Fuel | Tip | Mid | Rear | Avg. | End | SOT[a] | EOT[b] | | SOT | EOT | | SOT | EOT | |
| Base | 0 | 4.0 | 2.4 | 2.1 | 5.1 | 79.9 | 81.1 | 2.1 | 134 | 248 | 114 | 369 | 421 | 52 |
| | (0) | (1.2) | (1.9) | (1.0) | (4.2) | | | | | | | | | |
| A | 4.6 | 7.8 | 7.4 | 6.6 | 7.2 | 79.5 | 79.5 | 0 | 148 | 109 | −39 | 296 | 277 | −19 |
| | (1.2) | (7.1) | (6.0) | (4.8) | (6.5) | | | | | | | | | |

( ) = Numbers in parentheses denote worst deposit rating of the 4 nozzles.
[a] = Start of Test
[b] = End of Test The results presented in Table I show that there were less coking deposits, less engine noise and less hydrocarbon emissions with Fuel A, the fuel of the invention, as compared to the Base Fuel.

EXAMPLE 2

The test procedure of Example 1 was repeated with the exception that a different base fuel was used. The base fuel employed in this set of engine tests was a commercially available diesel fuel having a nominal cetane rating of 41.

A test blend was prepared from this base fuel (Fuel B), which contained 38 PTB of the reaction product of a polybutene substituted phenol in which the polybutene group had a molecular weight of about 900–1100, formaldehyde and N,N-dimethyl-1,3-propanediamine, 509 PTB of DII-3, 1.2 PTB of "Ethyl" Metal Deactivator, 1.0 PTB of Alox 1846, 19 PTB of Hysol 70B and 1.2 PTB of Tolad 286. The test results are given in Table II below.

TABLE 2

| | Injector Deposits, 10 = Clean | | | | | | | | | | | | | |
|---|---|---|---|---|---|---|---|---|---|---|---|---|---|---|
| | Pintle | | | | Nozzle | Noise Db (A) | | | HC, ppm | | | CO, ppm | | |
| Fuel | Tip | Mid | Rear | Avg. | End | SOT[a] | EOT[b] | | SOT | EOT | | SOT | EOT | |
| Base | 0.9 | 3.9 | 2.7 | 2.5 | 6.5 | 79.6 | 81.1 | 1.5 | 86 | 633 | 547 | 345 | 648 | 303 |
| | (0) | (1.4) | (1.0) | (0.8) | (5.7) | | | | | | | | | |
| B | 4.6 | 5.6 | 6.3 | 5.5 | 5.9 | 79.5 | 80.7 | 1.2 | 350 | 330 | −20 | 532 | 560 | 28 |
| | (2.2) | (2.8) | (5.2) | (3.4) | (5.0) | | | | | | | | | |

( ) = Numbers in parentheses denote worst deposit rating of the 4 nozzles.
[a] = Start of Test
[b] = End of Test

We claim:

1. Distillate fuel for indirect injection compression ignition engines containing at least the combination of (a) organic nitrate ignition accelerator, and (b) the condensation product of a high molecular weight alkylphenol, an aldehyde and an amine having at least one active hydrogen atom bonded to an amino nitrogen atom, said combination being present in an amount sufficient to minimize coking on the nozzles of indirect injection compression ignition engines operated on such fuel.

2. The composition of claim 1 wherein said ignition accelerator is a mixture of octyl nitrates.

3. The composition of claim 1 wherein said alkylphenol is a polybutene-substituted phenol in which the polybutene group has a molecular weight of about 900 to 1100, the aldehyde is formaldehyde and the amine is N,N-dimethyll,3-propanediamine.

4. A method of inhibiting coking on the injector nozzles of an indirect injection compression ignition engine which method comprises supplying said engine with a distillate fuel containing at least the combination of (a) organic nitrate ignition accelerator, and (b) the condensation product of a high molecular weight alkylphenol, an aldehyde and an amine having at least one active hydrogen atom bonded to an amino nitrogen atom said combination being present in an amount sufficient to minimize such coking in the engine when operated on such fuel.

5. The method of claim 4 wherein said ignition accelerator is a mixture of octyl nitrates.

6. The method of claim 4 wherein said alkylphenol is a polybutene-substituted phenol in which the polybutene group has a molecular weight of about 900 to 1100, the aldehyde is formaldehyde and the amine is N,N-dimethyl-1,3-propanediamine.

7. An additive fluid concentrate for use in distillate fuels containing at least the combination of (a) organic nitrate ignition accelerator, and (b) the condensation product of a high molecular weight alkylphenol, an aldehyde and an amine having at least one active hydrogen atom bonded to an amino nitrogen atom.

8. A concentrate of claim 7 comprising from about 5% to 95% by weight of said organic nitrate ignition accelerator and from about 95% to 5% by weight of said condensation product.

9. Distillate fuel for indirect injection compression ignition engines containing at least the combination of (a) organic nitrate ignition accelerator, and (b) the condensation product of:

(A) one mole part of an alkylphenol having the formula:

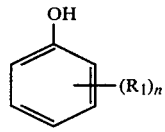

wherein n is an integer from 1 to 2 and $R_1$ is an aliphatic hydrocarbon radical having an average molecular weight of from about 400 to 1500;

(B) from 1–5 mole parts of an aldehyde having the formula:

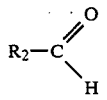

wherein $R_2$ is selected from hydrogen and alkyl radicals containing 1 to 6 carbon atoms; and (C) from 0.5–5 mole parts of an amine having at least one active hydrogen atom bonded to an amino nitrogen atom, said combination being present in an amount sufficient to minimize coking on the nozzles of indirect injection compression ignition engines operated on such fuel.

10. The composition of claim 9 wherein said ignition accelerator is a mixture of octyl nitrates,

11. The composition of claim 9 wherein said alkylphenol is a polybutene-substituted phenol in which the polybutene group has a molecular weight of about 900 to 1100, the aldehyde is formaldehyde and the amine is N,N-dimethyl-1,3-propanediamine.

12. A method of inhibiting coking on the injector nozzles of an indirect injection compression engine which method comprises supplying to said engine a distillate fuel containing at least the combination of (a) organic nitrate ignition accelerator, and (b) the condensation product of:

(A) one mole part of an alkylphenol having the formula:

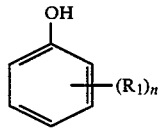

wherein n is an integer from 1 to 2 and $R_1$ is an aliphatic hydrocarbon radical having an average molecular weight of from about 400 to 1500;

(B) from 1–5 mole parts of an aldehyde having the formula:

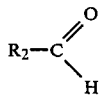

wherein $R_2$ is selected from hydrogen and alkyl radicals containing 1 to 6 carbon atoms; and (C) from 0.5–5 mole parts of an amine having at least one active hydrogen atom bonded to an amino nitrogen atom said combination being present in an amount sufficient to minimize such coking in the engine when operated on such fuel.

13. The method of claim 12 wherein said ignition accelerator is a mixture of octyl nitrates.

14. The method of claim 12 wherein said alkylphenol is a polybutene-substituted phenol in which the polybutene group has a molecular weight of about 900 to 1100, the aldehyde is formaldehyde and the amine is N,N-dimethyl-1,3-propanediamine.

15. An additive fluid concentrate for use in distillate fuels containing at least the combination of (a) organic nitrate injection accelerator and (b) the condensation product of:

(A) one mole part of an alkylphenol having the formula:

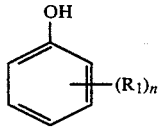

wherein n is an integer from 1 to 2 and $R_1$ is an aliphatic hydrocarbon radical having an average molecular weight of from about 400 to 1500;

(B) from 1–5 mole parts of an aldehyde having the formula:

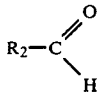

wherein $R_2$ is selected from hydrogen and alkyl radicals containing 1 to 6 carbon atoms; and (C) from 0.5–5 mole parts of an amine having at least one active hydrogen atom bonded to an amino nitrogen atom.

16. An additive fluid concentrate of claim 15 comprising from about 5% to 95% by weight of said organic nitrate ignition accelerator and from about 95% to 5% by weight of said condensation product.

* * * * *

UNITED STATES PATENT AND TRADEMARK OFFICE

CERTIFICATE OF CORRECTION

PATENT NO. : 4,553,979

DATED : November 19, 1985

INVENTOR(S) : J. VINCENT HANLON, DENIS L. LENANE, JAMES RETZLOFF

It is certified that error appears in the above-identified patent and that said Letters Patent is hereby corrected as shown below:

Column 6, line 66, reads "Thus, is a highly" and should read -- Thus, in a highly --.

Column 10, line 26, reads "1 750 0 24 off" and should read -- 1 750 0 4 off --.

Column 14, line 17, reads "nitrate injection accelerator" and should read -- nitrate ignition accelerator --.

Signed and Sealed this

*Twelfth* Day of *August 1986*

[SEAL]

*Attest:*

*Attesting Officer*

DONALD J. QUIGG

*Commissioner of Patents and Trademarks*